US012753959B2

(12) United States Patent
Su et al.

(10) Patent No.: US 12,753,959 B2
(45) Date of Patent: Oct. 6, 2026

(54) ECONOMIZER AND REFRIGERATION SYSTEM COMPRISING SAME

(71) Applicants: York (Wuxi) Air Conditioning and Refrigeration Co., Ltd., Wuxi (CN); Tyco Fire & Security GmbH, Neuhausen am Rheinfall (CH)

(72) Inventors: Xiuping Su, Wuxi (CN); Fang Xue, Wuxi (CN); Lu Mei, Wuxi (CN); Kun Lin, Wuxi (CN)

(73) Assignees: York (Wuxi) Air Conditioning and Refrigeration Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 81 days.

(21) Appl. No.: 18/696,926

(22) PCT Filed: Sep. 5, 2022

(86) PCT No.: PCT/CN2022/116990

§ 371 (c)(1),
(2) Date: Mar. 28, 2024

(87) PCT Pub. No.: WO2023/051175

PCT Pub. Date: Apr. 6, 2023

(65) Prior Publication Data

US 2024/0393023 A1 Nov. 28, 2024

(30) Foreign Application Priority Data

Sep. 28, 2021 (CN) ..... 202111139701.X

(51) Int. Cl.
*F25B 41/40* (2021.01)

(52) U.S. Cl.
CPC ..... *F25B 41/40* (2021.01); *F25B 2400/13* (2013.01)

(58) Field of Classification Search
CPC .... F25B 41/40; F25B 2400/13; F25B 43/003; F25B 43/006
See application file for complete search history.

(56) References Cited

U.S. PATENT DOCUMENTS

2015/0096315 A1 4/2015 Li et al.
2016/0238291 A1* 8/2016 Schreiber ..... F25B 39/028
2021/0156598 A1* 5/2021 Moore ..... F25B 43/00

FOREIGN PATENT DOCUMENTS

CN 1186209 A 7/1998
CN 2573983 Y * 9/2003
(Continued)

OTHER PUBLICATIONS

Park et al. (KR20150133565A), English Translation, Economizer comprising condenser and turbo chiller comprising the same, 2015, Whole Document (Year: 2015).*
(Continued)

*Primary Examiner* — Jerry-Daryl Fletcher
*Assistant Examiner* — Keith Stanley Myers
(74) *Attorney, Agent, or Firm* — Fletcher Yoder, P.C.

(57) ABSTRACT

An economizer includes an outer shell that internally includes a heat exchange cavity and a gas-liquid separation cavity. A heat exchange tube bundle is provided in the heat exchange cavity. The economizer is configured to enable refrigerants from a condenser to be subjected to heat exchange in the heat exchange cavity first, and then to be subjected to gas-liquid separation in the gas-liquid separation cavity after passing through a first-stage throttling device, such that gas refrigerants flow out of a gas outlet of the gas-liquid separation cavity, and liquid refrigerants flow out of a liquid outlet of the gas-liquid separation cavity.

14 Claims, 6 Drawing Sheets

(56) References Cited

FOREIGN PATENT DOCUMENTS

| | | | | | |
|---|---|---|---|---|---|
| CN | 101018992 | A | | 8/2007 | |
| CN | 101439235 | A | | 5/2009 | |
| CN | 103245144 | A | | 8/2013 | |
| CN | 105004106 | A | | 10/2015 | |
| CN | 105402953 | A | | 3/2016 | |
| CN | 205332616 | U | | 6/2016 | |
| CN | 106352608 | A | | 1/2017 | |
| CN | 106871501 | A | | 6/2017 | |
| CN | 107677016 | A | | 2/2018 | |
| CN | 111637667 | A | | 9/2020 | |
| CN | 112762641 | A | * | 5/2021 | ..... F25B 43/00 |
| CN | 214250208 | U | | 9/2021 | |
| CN | 113819684 | A | | 12/2021 | |
| JP | H04203851 | A | | 7/1992 | |
| JP | 2001066022 | A | | 3/2001 | |
| JP | 2011038742 | A | | 2/2011 | |
| KR | 20150133565 | A | | 11/2015 | |
| KR | 20200005152 | A | | 1/2020 | |

OTHER PUBLICATIONS

Wang et al. (CN112762641A), English Translation, Heat regenerator and refrigerating system comprising same, 2021, Whole Document (Year: 2021).*

Xie et al. (CN2573983Y), English Translation, Ammonioa synthetic gas cooling and condensing separator, 2003, Whole Document (Year: 2003).*

PCT International Search Report for PCT Application No. PCT/CN2022/116990, mailed Dec. 1, 2022, 3 pgs.

* cited by examiner

ECONOMIZER AND REFRIGERATION SYSTEM COMPRISING SAME

CROSS-REFERENCE TO RELATED APPLICATIONS

This application is a U.S. National Stage Application of PCT Application No. PCT/CN2022/116990, entitled "Economizer and Refrigerating System Comprising Same," filed Sep. 5, 2022, which claims priority to and the benefit of Chinese Patent Application No. 202111139701.X, filed Sep. 28, 2021, each of which is herein incorporated by reference in its entirety for all purposes.

TECHNICAL FIELD

The present application relates to an economizer and a refrigeration system including same, and is particularly suitable for two-stage compression refrigeration systems.

BACKGROUND ART

A refrigeration system generally comprises a compressor, a condenser, a throttling device, and an evaporator, which are connected in turn to form a refrigerant circulation system to heat or cool the outside. Some refrigeration systems further comprise a subcooler and an economizer. The subcooler is provided inside the condenser to further cool condensed refrigerants to increase the refrigeration efficiency and the cooling capacity of the refrigeration systems. The economizer is used to carry out gas-liquid separation on the gas-liquid two-phase refrigerants after passing through a first-stage throttling device, wherein gas refrigerants return to an air supplementing port of the compressor, and liquid refrigerants enter the evaporator for evaporation after passing through a second-stage throttling device.

SUMMARY OF THE INVENTION

At least one object of the first aspect of the present application is to provide an economizer that can perform not only a function of gas-liquid separation but also a function of heat exchange. The economizer comprises: an outer shell that internally comprises a heat exchange cavity and a gas-liquid separation cavity and has a length direction; a heat exchange tube bundle provided in the heat exchange cavity and extending along the length direction; an inlet of the heat exchange cavity and an outlet of the heat exchange cavity, which are in fluid communication with the heat exchange cavity; and an inlet of the gas-liquid separation cavity, a gas outlet of the gas-liquid separation cavity, and a liquid outlet of the gas-liquid separation cavity, which are provided on the outer shell and are in fluid communication with the gas-liquid separation cavity, wherein the inlet of the gas-liquid separation cavity is in fluid communication with the outlet of the heat exchange cavity through a first-stage throttling device, and the inlet of the gas-liquid separation cavity and the gas outlet of the gas-liquid separation cavity are provided to be spaced by a certain distance in the length direction; and wherein the economizer is configured to enable refrigerants from a condenser to be subjected to heat exchange in the heat exchange cavity first, and then to be subjected to gas-liquid separation in the gas-liquid separation cavity after passing through the first-stage throttling device, such that gas refrigerants flow out of the gas outlet of the gas-liquid separation cavity, and liquid refrigerants flow out of the liquid outlet of the gas-liquid separation cavity.

According to the above first aspect, the economizer further comprises an inner shell, wherein the inner shell and the outer shell are cylindrical, the outer shell is provided surrounding the inner shell, an axial direction of the inner shell and the outer shell is the length direction, an inside of the inner shell forms the heat exchange cavity, and the gas-liquid separation cavity is formed between the inner shell and the outer shell; and wherein the inlet of the heat exchange cavity and the outlet of the heat exchange cavity are provided on the inner shell.

According to the above first aspect, the economizer further comprises a gas-liquid separation cavity inlet tube, wherein the gas-liquid separation cavity inlet tube is connected to the inlet of the gas-liquid separation cavity, and the gas-liquid separation cavity inlet tube extends along a tangential direction of the outer shell, so that the refrigerants flow spirally along the length direction around the inner shell in the gas-liquid separation cavity, thereby achieving gas-liquid separation under the action of centrifugal force.

According to the above first aspect, the inner shell and the outer shell are coaxially provided.

According to the above first aspect, the inlet of the gas-liquid separation cavity is provided on one side of the outer shell close to a bottom; and in a width direction and/or a height direction of the inner shell and the outer shell, an axis of the inner shell is arranged offset from an axis of the outer shell, and the inner shell is arranged away from the inlet of the gas-liquid separation cavity.

According to the above first aspect, the economizer comprises a partition plate, wherein the partition plate divides an inside of the outer shell into the heat exchange cavity and the gas-liquid separation cavity, and the inlet of the heat exchange cavity and the outlet of the heat exchange cavity are provided on the outer shell; and the inlet of the gas-liquid separation cavity is configured to guide the refrigerants into the gas-liquid separation cavity along one end of the gas-liquid separation cavity in a length direction, such that the refrigerants flow along the length direction in the gas-liquid separation cavity, thereby achieving gas-liquid separation under the action of gravity.

According to the above first aspect, the economizer further comprises at least one filter screen, and the at least one filter screen is provided on a flow path of the refrigerants in the gas-liquid separation cavity.

According to the above first aspect, the liquid outlet of the gas-liquid separation cavity is connected to a liquid collection tube and a plurality of outlet branch tubes, and the plurality of outlet branch tubes are each in fluid communication with the liquid collection tube along a length direction of the liquid collection tube.

According to the above first aspect, the refrigerants from the condenser are subjected to heat exchange in the heat exchange cavity through outer walls of heat exchange tubes in the heat exchange tube bundle.

According to the above first aspect, the gas refrigerants flow out of the gas outlet of the gas-liquid separation cavity and are provided to an air supplementing port of a compressor, and the liquid refrigerants flow out of the liquid outlet of the gas-liquid separation cavity and are provided to a second-stage throttling device.

According to the above first aspect, the economizer further comprises a liquid storage tank and a liquid level sensor, wherein the liquid storage tank is in fluid communication with the liquid outlet of the gas-liquid separation cavity to receive the liquid refrigerants, and the liquid level sensor is in communication connection with the second-stage throttling device; and wherein the liquid level sensor is configured to detect a liquid level height in the liquid storage tank, and to control an opening degree of the second-stage throttling device based on a detection result.

According to the above first aspect, the inlet of the gas-liquid separation cavity and the gas outlet of the gas-liquid separation cavity are provided close to two ends of the outer shell in the length direction.

At least one object of the second aspect of the present application is to provide a refrigeration system, comprising: a compressor, a condenser, an economizer, a second-stage throttling device, and an evaporator, which are provided in a refrigerant circuit; wherein the economizer comprises: an outer shell that internally comprises a heat exchange cavity and a gas-liquid separation cavity and has a length direction; a heat exchange tube bundle provided in the heat exchange cavity and extending along the length direction; an inlet of the heat exchange cavity and an outlet of the heat exchange cavity, which are in fluid communication with the heat exchange cavity, the inlet of the heat exchange cavity being in fluid communication with an outlet of the condenser; and an inlet of the gas-liquid separation cavity, a gas outlet of the gas-liquid separation cavity, and a liquid outlet of the gas-liquid separation cavity, which are provided on the outer shell and are in fluid communication with the gas-liquid separation cavity, wherein the inlet of the gas-liquid separation cavity is in fluid communication with the outlet of the heat exchange cavity through a first-stage throttling device, the gas outlet of the gas-liquid separation cavity is in fluid communication with an air supplementing port of the compressor, the liquid outlet of the gas-liquid separation cavity is in fluid communication with an inlet of the second-stage throttling device, and the inlet of the gas-liquid separation cavity and the gas outlet of the gas-liquid separation cavity are provided to be spaced by a certain distance in the length direction; and wherein the economizer is configured to enable refrigerants from the condenser to be subjected to heat exchange in the heat exchange cavity first, and then to be subjected to gas-liquid separation in the gas-liquid separation cavity after passing through the first-stage throttling device, such that gas refrigerants flow out of the gas outlet of the gas-liquid separation cavity and are provided to the air supplementing port of the compressor, and liquid refrigerants flow out of the liquid outlet of the gas-liquid separation cavity and are provided to the second-stage throttling device.

DETAILED DESCRIPTION OF EMBODIMENTS

Various specific embodiments of the present application will be described below with reference to the accompanying drawings, which constitute a part of the specification. It should be understood that although terms, such as "front," "rear," "upper," "lower," "left," "right," "top," "bottom," etc., that represent directions are used in the present application to describe various example structural parts and elements of the present application, these terms used herein are determined based on example orientations shown in the accompanying drawings for ease of illustration only. Since the embodiments disclosed in the present application may be disposed in different directions, these terms that represent directions are for illustration only and should not be regarded as limiting.

Figure 1:
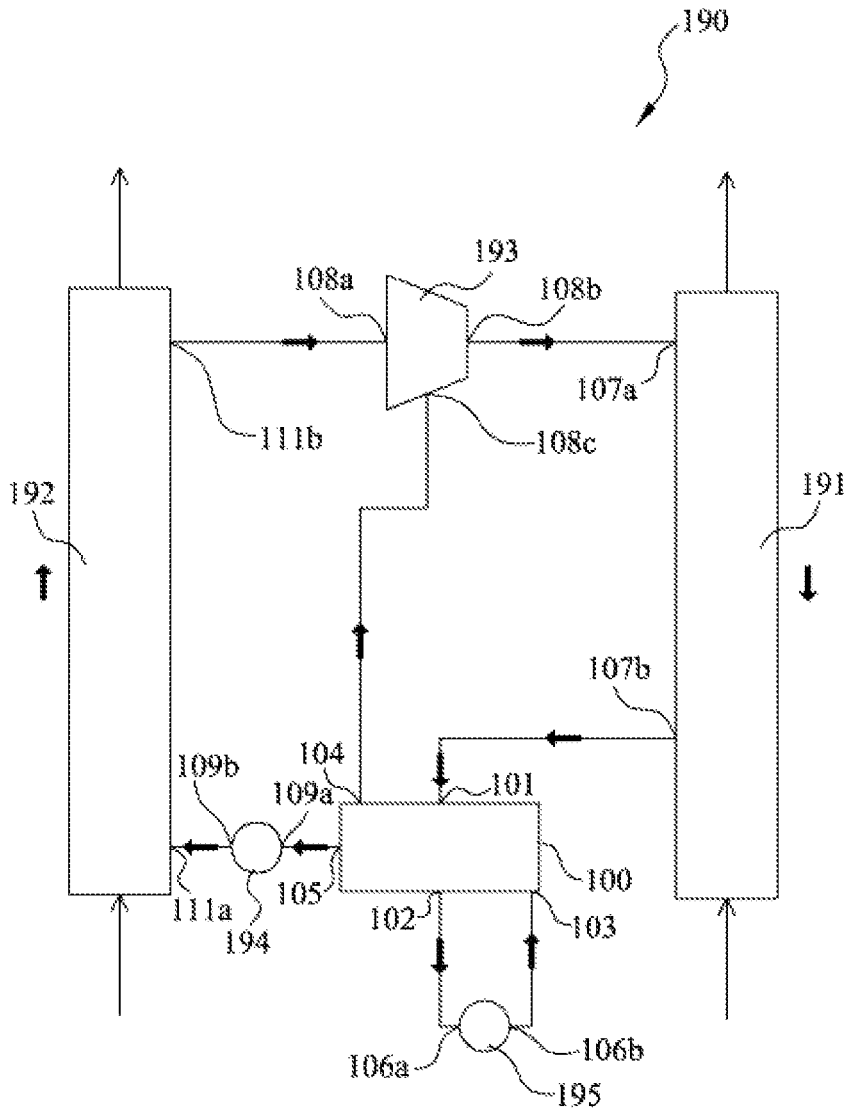
FIG. 1 is a structural block diagram of an embodiment of a refrigeration system of the present application.

FIG. 1 is a structural block diagram of an embodiment of a refrigeration system 190 of the present application that is used to show a connection relationship of various components in a two-stage compression refrigeration system. As shown in FIG. 1, the refrigeration system 190 comprises a compressor 193, a condenser 191, an economizer 100, a second-stage throttling device 194, and an evaporator 192, which are connected in turn through a pipe to form a refrigerant circulation loop. The economizer 100 internally comprises a heat exchange cavity 218 and a gas-liquid separation cavity 217 (see FIG. 2A).

Specifically, the compressor 193 has an air suction port 108*a*, an exhaust port 108*b*, and an air supplementing port 108*c*. The condenser 191 has an inlet 107*a* and an outlet 107*b*. The second-stage throttling device 194 has an inlet 109*a* and an outlet 109*b*. The evaporator 192 has an inlet 111*a* and an outlet 111*b*. The economizer 100 has an inlet 101 of the heat exchange cavity, a gas outlet 104 of the gas-liquid separation cavity, and a liquid outlet 105 of the gas-liquid separation cavity. The refrigeration system 190 further comprises a first-stage throttling device 195. The first-stage throttling device 195 has an inlet 106*a* and an outlet 106*b*. The economizer 100 also has an outlet 102 of the heat exchange cavity and an inlet 103 of the gas-liquid separation cavity.

The exhaust port 108*b* of the compressor 193 is in fluid communication with the inlet 107*a* of the condenser 191, the outlet 107*b* of the condenser 191 is in fluid communication with the inlet 101 of the heat exchange cavity of the economizer 100, and the inlet 101 of the heat exchange cavity is provided below the outlet 107*b* of the condenser 191, the outlet 102 of the heat exchange cavity of the economizer 100 is in fluid communication with the inlet 106*a* of the first-stage throttling device 195, the outlet 106*b* of the first-stage throttling device 195 is in fluid communication with the inlet 103 of the gas-liquid separation cavity of the economizer 100, the gas outlet 104 of the gas-liquid separation cavity of the economizer 100 is in fluid communication with the air supplementing port 108*c* of the compressor 193, the liquid outlet 105 of the gas-liquid separation cavity of the economizer 100 is in fluid communication with the inlet 109*a* of the second-stage throttling device 194, the outlet 109*b* of the second-stage throttling device 194 is in fluid communication with the inlet 111*a* of the evaporator 192, and the outlet 111*b* of the evaporator 192 is in fluid communication with the air suction port 108*a* of the compressor 193.

The refrigeration system 190 is filled with refrigerants. The operation process of the refrigeration system 190 is briefly described below:

In the compressor 193, a low-temperature and low-pressure gas refrigerant is compressed into a high-temperature and high-pressure gas refrigerant. Then, the high-temperature and high-pressure gas refrigerant flows into the condenser 191, and releases heat and is condensed into a high-pressure liquid refrigerant in the condenser 191. The high-pressure liquid refrigerant enters the economizer 100 through the inlet 101 of the heat exchange cavity. In the economizer 100, the high-pressure liquid refrigerant first passes through the heat exchange cavity 218 (see FIGS. 2A and 2B), and is subjected to heat exchange in the heat exchange cavity 218 to be further cooled into a subcooled liquid refrigerant, and then the subcooled liquid refrigerant flows out from the outlet 102 of the heat exchange cavity to the first-stage throttling device 195. After the first throttling, a medium-pressure liquid refrigerant and gas refrigerant mixture (hereinafter referred to as a gas-liquid mixture) is obtained, and then enters the gas-liquid separation cavity 217 (see FIGS. 2A and 2B) through the inlet 103 of the gas-liquid separation cavity for gas-liquid separation, wherein the gas refrigerant flows out from the gas outlet 104 of the gas-liquid separation cavity and returns to the compressor 193 via the air supplementing port 108*c* to be recompressed into a high-temperature and high-pressure gas refrigerant; and wherein the liquid refrigerant flows out from the liquid outlet 105 of the gas-liquid separation cavity to the second-stage throttling device 194 for second throttling. The throttled low-pressure refrigerant enters the evaporator 192 to absorb heat and evaporate into a gas refrigerant, and finally returns to the compressor 193 from the air suction port 108*a* to be recompressed into a high-temperature and high-pressure gas refrigerant. In this way, a continuous refrigeration cycle is completed.

Figure 2A:
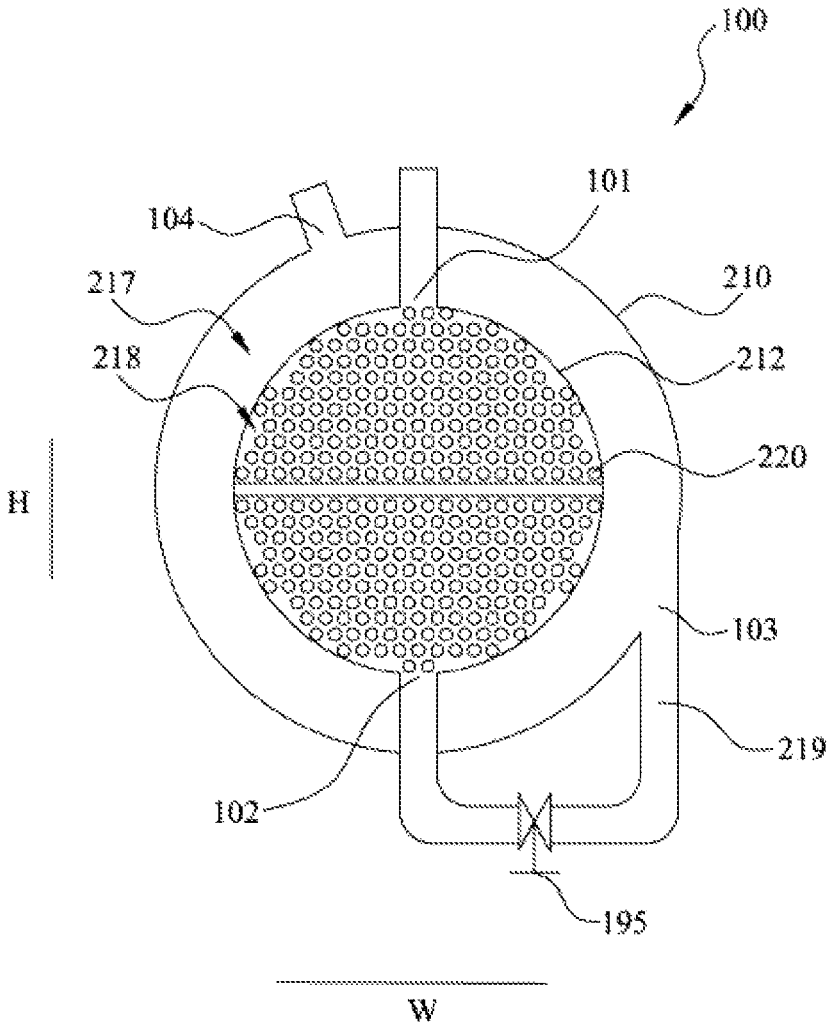
FIG. 2A is a schematic radial cross-sectional view of a first embodiment of the economizer in FIG. 1.
Figure 2B:
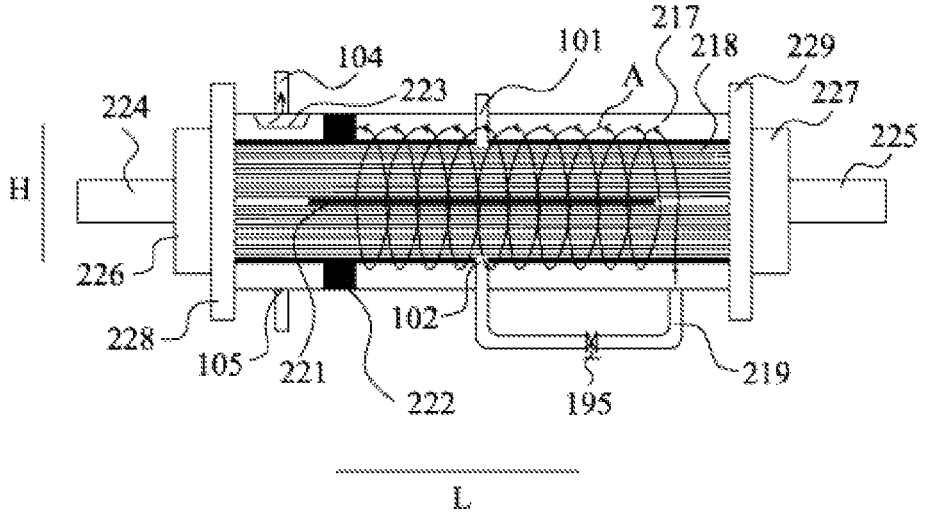
FIG. 2B is a schematic axial cross-sectional view of the economizer in FIG. 2A.

FIGS. 2A and 2B show a specific structure of a first embodiment of the economizer 100 in FIG. 1; wherein FIG. 2A is a schematic radial cross-sectional view of the economizer 100 that is used to show the general structure of the economizer 100 in the width direction and the height direction, and FIG. 2B is a schematic axial cross-sectional view of the economizer 100 that is used to show the general structure of the economizer 100 in the length direction and the height direction.

As shown in FIGS. 2A and 2B, the economizer 100 comprises an outer shell 210, and an inside of the outer shell 210 forms a heat exchange cavity 218 and a gas-liquid separation cavity 217. The outer shell 210 has a length direction L, a width direction W, and a height direction H, and the heat exchange cavity 218 and the gas-liquid separation cavity 217 extend along the common length direction L. The economizer 100 further comprises an inner shell 212, wherein the outer shell 210 and the inner shell 212 are generally cylindrical, and their axial direction is the length direction L. In the present embodiment, the outer shell 210 and the inner shell 212 are coaxially provided. The outer shell 210 is provided surrounding the inner shell 212, an inside of the inner shell 212 forms a generally cylindrical heat exchange cavity 218, and a generally annular cylindrical gas-liquid separation cavity 217 is formed between the inner shell 212 and the outer shell 210.

The economizer 100 further comprises a heat exchange tube bundle 220. The heat exchange tube bundle 220 is provided in the heat exchange cavity 218, and each heat exchange tube in the heat exchange tube bundle 220 extends along the length direction L. The outer shell 210 further comprises a front tube plate 228 and a rear tube plate 229, which are provided at two ends of the outer shell 210 in the length direction L, and are used to close the heat exchange cavity 218 and the gas-liquid separation cavity 217. The two ends of each heat exchange tube in the heat exchange tube bundle 220 are respectively supported on the front tube plate 228 and the rear tube plate 229, and the inside of the heat exchange tube is in fluid communication with a front water tank 226 and a rear water tank 227 through the front tube plate 228 and the rear tube plate 229, respectively. The front end of the heat exchange tube is in fluid communication with a water inlet 224 through the front tube plate 228 and the front water tank 226, and the rear end of the heat exchange tube is in fluid communication with a water outlet 225 through the rear tube plate 229 and the rear water tank 227. The water inlet 224 and the water outlet 225 can be in fluid communication with a cooling medium, and in fluid communication with the inside of each heat exchange tube in the heat exchange tube bundle 220, for providing the cooling medium for heat exchange, such as cold water, to the inside of the heat exchange tube. The cooling medium flows from left to right along the length direction L inside each heat exchange tube of the heat exchange tube bundle.

The inlet 101 of the heat exchange cavity and the outlet 102 of the heat exchange cavity are provided on the inner shell 212 and are in fluid communication with the heat exchange cavity 218. In the present embodiment, the inlet 101 of the heat exchange cavity and the outlet 102 of the heat exchange cavity are provided at the top and bottom in the height direction H of the inner shell 212, respectively, such that a refrigerant flowing into the heat exchange cavity 218 from the inlet 101 of the heat exchange cavity flows generally from top to bottom. The inlet 101 of the heat exchange cavity and the outlet 102 of the heat exchange cavity are provided generally in the middle in the length direction L of the inner shell 212. In order to allow the refrigerant flowing into the heat exchange cavity 218 from the inlet 101 of the heat exchange cavity to have a certain flow stroke, a pass partition plate 221 is also provided in the heat exchange cavity 218. The pass partition plate 221 is provided laterally on a refrigerant flow path between the inlet 101 of the heat exchange cavity and the outlet 102 of the heat exchange cavity, such that after entering the heat exchange cavity 218 from the inlet 101 of the heat exchange cavity, the refrigerant flows to the left and right sides in the length direction L because of being blocked by the pass partition plate 221 to be subjected to full heat exchange with the cooling medium through an outer wall of the heat exchange tube, and meanwhile flows downward to be discharged from the outlet 102 of the heat exchange cavity under the action of gravity. And in the present embodiment, the cooling medium flowing in the heat exchange tubes of the heat exchange tube bundle 220 is cold water to further cool the refrigerant flowing in from the inlet 101 of the heat exchange cavity, such that the refrigerant reaches a subcooled liquid state.

The first-stage throttling device 195 is connected between the outlet 102 of the heat exchange cavity and the inlet 103 of the gas-liquid separation cavity, such that the subcooled liquid refrigerant flowing out from the outlet 102 of the heat exchange cavity can be throttled by the first-stage throttling device 195, and then the gas-liquid mixture obtained by throttling is transported from the inlet 103 of the gas-liquid separation cavity to the gas-liquid separation cavity 217 for gas-liquid separation.

The inlet 103 of the gas-liquid separation cavity, the gas outlet 104 of the gas-liquid separation cavity, and the liquid outlet 105 of the gas-liquid separation cavity are provided on the outer shell 210 and are in fluid communication with the gas-liquid separation cavity 217. In the present embodiment, the inlet 103 of the gas-liquid separation cavity and the gas outlet 104 of the gas-liquid separation cavity are provided to be spaced by a certain distance in the length direction L of the outer shell 210, such that a gas flow formed by the refrigerant can have a certain flow stoke. In the present embodiment, a gas-liquid separation cavity inlet tube 219 is connected to the inlet 103 of the gas-liquid separation cavity. The gas-liquid separation cavity inlet tube 219 communicates with an outlet of the first-stage throttling device 195, and the gas-liquid separation cavity inlet tube 219 extends along a tangential direction of the outer shell 210 to guide the gas-liquid mixture discharged from the first-stage throttling device 195 into the gas-liquid separation cavity 217 along a tangential direction of the gas-liquid separation cavity 217. A gas flow shown by the arrow and flowing rotationally in a spiral shape along the length direction L is formed in the gas-liquid separation cavity 217. Since the gas refrigerants and the liquid refrigerants have different densities, when they flow rotationally in a spiral shape together, a centrifugal force experienced by the liquid refrigerants is greater than that experienced by the gas refrigerants, so that the gas-liquid mixture can realize gas-liquid separation under the action of the centrifugal force; wherein the gas refrigerants with lower density continue to flow forward in a spiral shape until they are discharged from the gas outlet 104 of the gas-liquid separation cavity, and wherein the liquid refrigerants with higher density adhere to the outer surface of the inner shell 212 and are collected to the bottom of the gas-liquid separation cavity 217 to form a liquid level of a certain height until they flow out from the liquid outlet 105 of the gas-liquid separation cavity. In the present embodiment, the gas-liquid separation cavity inlet tube 219 extends upward generally along the tangential direction of the outer shell 210, such that the inlet 103 of the gas-liquid separation cavity is generally close to the right side of the bottom of the outer shell 210.

The economizer 100 further comprises a filter screen 222 and a liquid baffle 223. The filter screen 222 is longitudinally provided in the gas-liquid separation cavity 217 and is provided on a flow path of the gas flow formed by the gas-liquid mixture to absorb the liquid refrigerants in the gas flow. In order to further reduce the liquid refrigerants in the gas flow, multiple filter screens 222 may also be provided at intervals in the length direction L. The liquid baffle 223 is provided at the gas outlet 104 of the gas-liquid separation cavity to further prevent liquid droplets from being entrained in the gas flow discharged from the gas outlet 104 of the gas-liquid separation cavity.

In the present embodiment, the heat exchange cavity 218 and the gas-liquid separation cavity 217 are provided in the outer shell 210 of the economizer 100. The refrigerant is first subjected to heat exchange in the heat exchange cavity 218 to be subcooled, and is then throttled by the first-stage throttling device 195 into a gas-liquid mixture, and then the gas-liquid mixture is subjected to gas-liquid separation in the gas-liquid separation cavity 217 through the principle of centrifugal separation. Therefore, the economizer 100 can realize both the heat exchange function and the gas-liquid separation function. The inner shell 212 is provided inside the outer shell 210, which not only has a compact structure and saves space, but also has a good gas-liquid separation effect by using a centrifugal force.

In addition, generally speaking, when a subcooler is provided in the condenser, a certain refrigerant charge quantity is required in the refrigeration system, so that the refrigerant that needs to be subcooled can immerse the heat exchange tube bundle. In the refrigeration system of the present embodiment, there is no need to provide the subcooler in the condenser. It is only necessary to provide the inlet 101 of the heat exchange cavity below the outlet **107*b* of the condenser 191 to ensure that the heat exchange tube bundle 220** is immersed in the refrigerant. Therefore, a smaller refrigerant charge quantity is required in the condenser to achieve the same degree of subcooling. When the number of the heat exchange tubes in the condenser is the same, a shell of the condenser can be smaller in size. When the size of the shell of the condenser is the same, the number of the heat exchange tubes in the condenser is increased.

In the economizer 100 of the present embodiment, the outer shell 210 and the inner shell 212 are coaxially cylindrical. In some other embodiments, the outer shell 210 and the inner shell 212 may also be provided non-axially.

Figure 3:
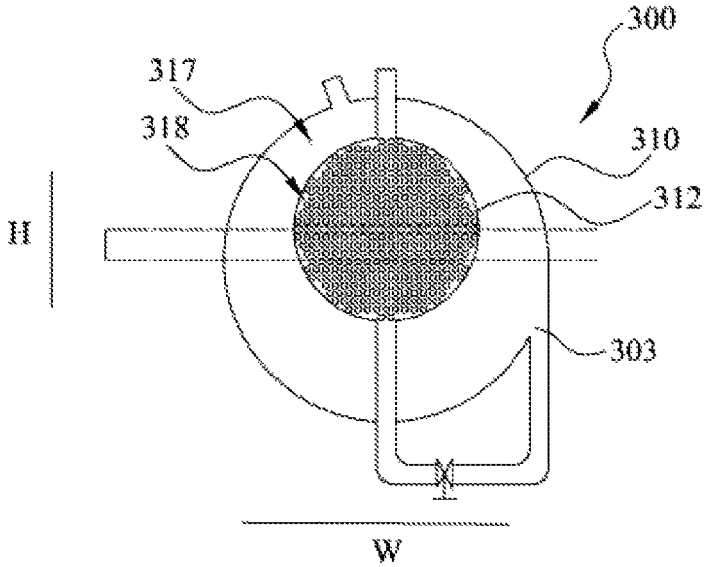
FIG. 3 is a schematic radial cross-sectional view of a second embodiment of the economizer in FIG. 1.

FIG. 3 is a schematic radial cross-sectional view of a second embodiment of the economizer in FIG. 1, showing another embodiment of the economizer. As shown in FIG. 3, similar to the economizer 100, the economizer 300 further comprises a cylindrical outer shell 310 and a cylindrical inner shell 312. The inner shell 312 is provided inside the outer shell 310, such that an inside of the inner shell 312 forms a heat exchange cavity 318, and a gas-liquid separation cavity 317 is formed between the inner shell 312 and the outer shell 310. And the axial directions of the outer shell 310 and the inner shell 312 form a length direction L.

However, what is different from the economizer 100 is that in the economizer 300, the outer shell 310 and the inner shell 312 are no longer coaxially provided. The axes of the outer shell 310 and the inner shell 312 are at the same position in the width direction W, but are staggered in the height direction H. For example, the axis of the inner shell 312 is offset from the axis of the outer shell 310 along the height direction H in a direction away from an inlet 303 of the gas-liquid separation cavity.

Figure 4:
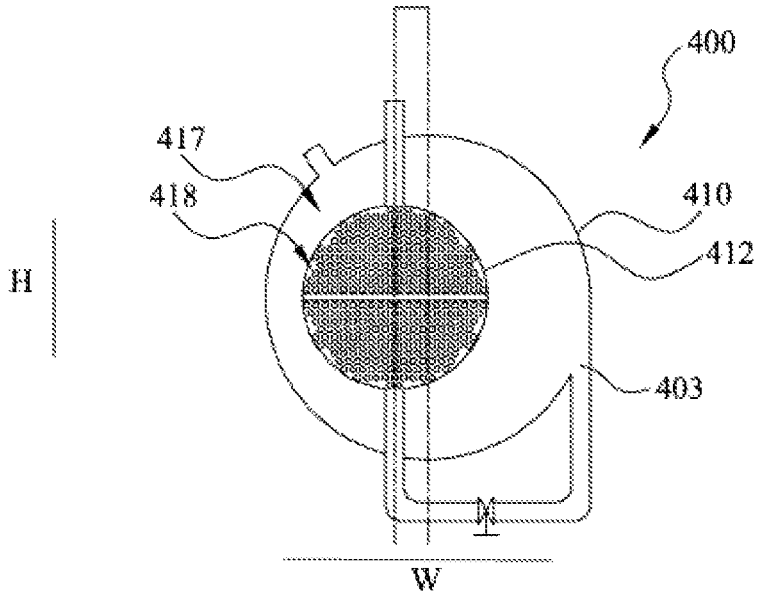
FIG. 4 is a schematic radial cross-sectional view of a third embodiment of the economizer in FIG. 1.

FIG. 4 is a schematic radial cross-sectional view of a third embodiment of the economizer in FIG. 1, showing yet another embodiment of the economizer. As shown in FIG. 4, similar to the economizer 100, the economizer 400 further comprises a cylindrical outer shell 410 and a cylindrical inner shell 412. The inner shell 412 is provided inside the outer shell 410, such that an inside of the inner shell 412 forms a heat exchange cavity 418, and a gas-liquid separation cavity 417 is formed between the inner shell 412 and the outer shell 410. And the axial directions of the outer shell 410 and the inner shell 412 form a length direction L.

In the economizer 400, the outer shell 410 and the inner shell 412 are not coaxially provided either. However, what is different from the economizer 300 is that the axes of the outer shell 410 and the inner shell 412 are at the same position in the height direction H, but are staggered in the width direction W. For example, the axis of the inner shell 412 is offset from the axis of the outer shell 410 along the width direction W in a direction away from an inlet 403 of the gas-liquid separation cavity.

Figure 5:
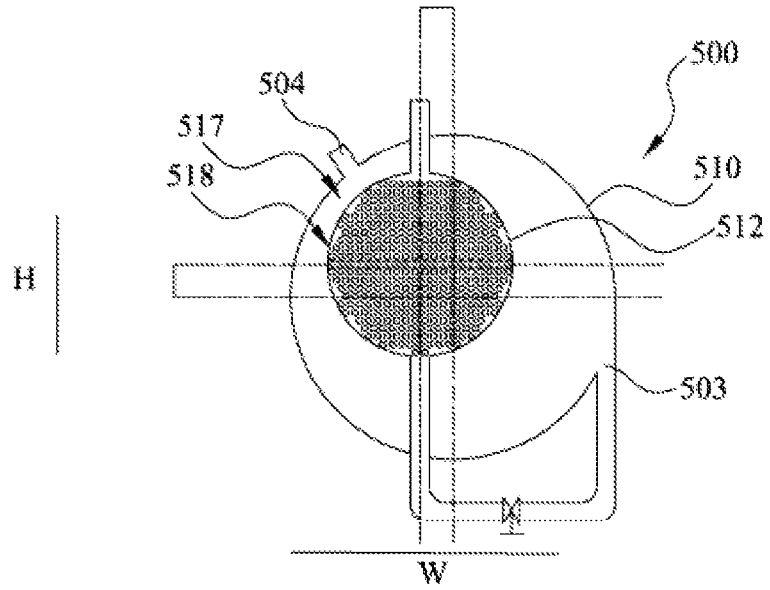
FIG. 5 is a schematic radial cross-sectional view of a fourth embodiment of the economizer in FIG. 1.

FIG. 5 is a schematic radial cross-sectional view of a fourth embodiment of the economizer in FIG. 1, showing yet another embodiment of the economizer. As shown in FIG. 5, similar to the economizer 100, the economizer 500 further comprises a cylindrical outer shell 510 and a cylindrical inner shell 512. The inner shell 512 is provided inside the outer shell 510, such that an inside of the inner shell 512 forms a heat exchange cavity 518, and a gas-liquid separation cavity 517 is formed between the inner shell 512 and the outer shell 510. And the axial directions of the outer shell 510 and the inner shell 512 form a length direction L.

In the economizer 500, the outer shell 510 and the inner shell 512 are not coaxially provided. However, what is different from the economizer 300 is that the axes of the outer shell 510 and the inner shell 512 are staggered in both the height direction H and the width direction W. For example, the axis of the inner shell 512 is offset from the axis of the outer shell 510 along both the width direction W and the height direction H in a direction away from an inlet 503 of the gas-liquid separation cavity.

In the economizer 300, the economizer 400, and the economizer 500 as shown in FIGS. 3 to 5, each outer shell and the corresponding inner shell are not coaxially provided, but the inner shell is provided offset from the axis of the outer shell in a direction away from the inlet of the gas-liquid separation cavity. Such an arrangement can increase the space at the inlet of the gas-liquid separation cavity, which is beneficial to reducing the pressure drop of the gas-liquid mixture in the gas-liquid separation cavity. For example, under certain same operating conditions, in the economizer 100 as shown in FIGS. 2A and 2B, the pressure drop between the inlet 103 of the gas-liquid separation cavity and the gas outlet 104 of the gas-liquid separation cavity is generally 5.44 kPa, but in the economizer 500 as shown in FIG. 5, the pressure drop between the inlet 503 of the gas-liquid separation cavity and the gas outlet 504 of the gas-liquid separation cavity is only 3.89 kPa.

In addition, since the inlet of the gas-liquid separation cavity is provided close to the side of the bottom of the outer shell, providing the inner shell away from the inlet of the gas-liquid separation cavity can be also beneficial to reducing the disturbance of the gas flow to the liquid level at the bottom of the outer shell, thereby improving the stability of the liquid level formed by the liquid refrigerants.

Figure 6:
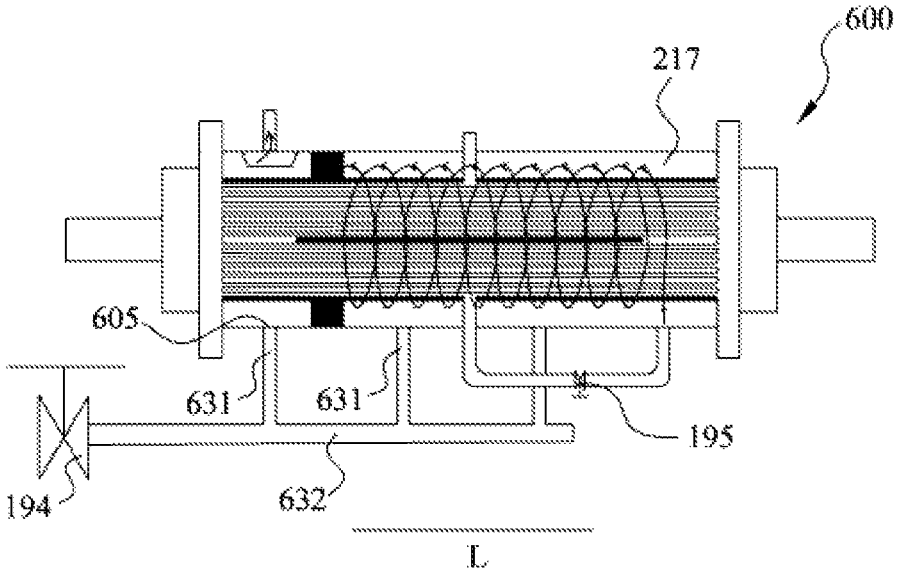
FIG. 6 is a schematic axial cross-sectional view of a fifth embodiment of the economizer in FIG. 1.

FIG. 6 is a schematic axial cross-sectional view of a fifth embodiment of the economizer in FIG. 1, showing yet another embodiment of the economizer. As shown in FIG. 6, the structure of the economizer 600 is generally the same as that of the economizer 100. The only difference is that multiple liquid outlets 605 of the gas-liquid separation cavity are provided along the length direction L, and the economizer 600 further comprises a plurality of outlet branch tubes 631 and liquid collection tubes 632, which are connected to the liquid outlet 605 of the gas-liquid separation cavity. One end of each outlet branch tube 631 is connected to the corresponding liquid outlet 605 of the gas-liquid separation cavity, and the other end of each outlet branch tube 631 is connected to the liquid collection tube 632 along a length direction of the liquid collection tube 632. In the present embodiment, the length direction of the liquid collection tube 632 is generally the same as the length direction L, and each outlet branch tube 631 is arranged along the length direction of the liquid collection tube 632 and is respectively in fluid communication with the liquid collection tube 632. Therefore, the liquid refrigerants separated in the economizer 600 can be discharged through the liquid outlets 605 of the gas-liquid separation cavity and the corresponding outlet branch tubes 631, and then collected through the liquid collection tubes 632 and transported to the second-stage throttling device 194.

In the present embodiment, due to the provision of the multiple liquid outlets 605 of the gas-liquid separation cavity and outlet branch tubes 631, the liquid refrigerants after gas-liquid separation can be discharged in a timelier manner, so as to reduce or prevent the liquid refrigerants from forming a liquid level at the bottom of the gas-liquid separation cavity 217.

Figure 7:
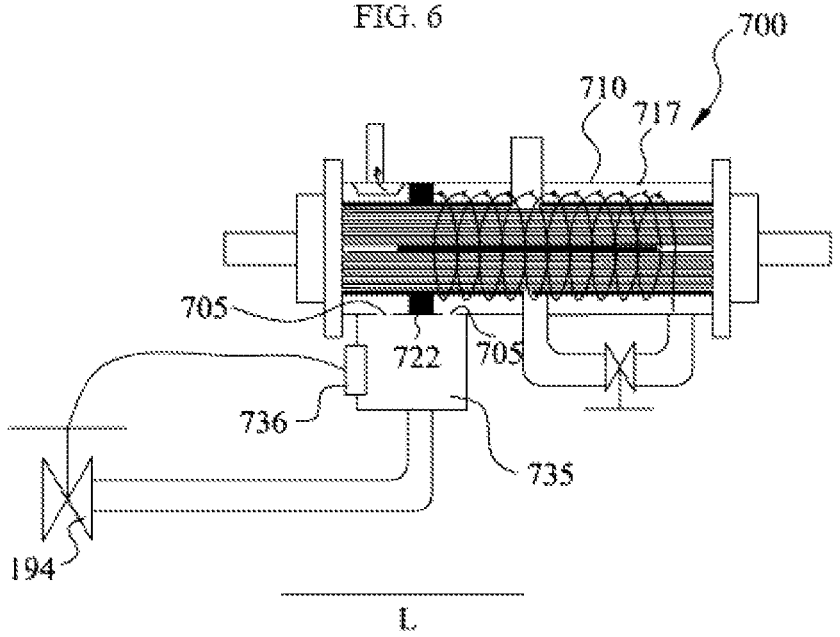
FIG. 7 is a schematic axial cross-sectional view of a sixth embodiment of the economizer in FIG. 1.

FIG. 7 is a schematic axial cross-sectional view of a sixth embodiment of the economizer in FIG. 1, showing yet another embodiment of the economizer. As shown in FIG. 7, the structure of the economizer 700 is generally the same as that of the economizer 100. The only difference is that the economizer further comprises a liquid storage tank 735 and a liquid level sensor 736, wherein the liquid storage tank 735 is provided outside an outer shell 710 of the economizer 700, and is in fluid communication with a liquid outlet 705 of the gas-liquid separation cavity to receive the liquid refrigerants discharged from the liquid outlet 705 of the gas-liquid separation cavity and store these liquid refrigerants in the liquid storage tank 735. The liquid level sensor 736 is communicatively connected to the liquid storage tank 735 and to the second-stage throttling device 194. The liquid level sensor 736 is used to detect a liquid level height of the liquid refrigerants stored in the liquid storage tank 735, and control an opening degree of the second-stage throttling device 194 based on the detection result. As a specific example, the number of the liquid outlets 705 of the gas-liquid separation cavity is two, and the two liquid outlets of the gas-liquid separation cavity are provided on two sides of a filter screen 722 in a length direction L, respectively. This is because a gas flow in a gas-liquid separation cavity 717 is relatively easy to disturb a liquid level formed by the liquid refrigerants near the filter screen 722, so that the liquid refrigerants need to be discharged in a timely manner near the filter screen 722.

In the present embodiment, by providing the liquid storage tank 735 and the liquid level sensor 736, the economizer 700 can provide the liquid refrigerants to the second-stage throttling device 194 more stably, and adjust the opening degree of the second-stage throttling device 194 according to the amount of the liquid refrigerants, so that the operation of the refrigeration system 190 is more stable and reliable.

Those skilled in the art can understand that in the embodiments of FIGS. 6 and 7, the structure of a gas-liquid separation cavity liquid outlet portion of the economizer is improved, so that the liquid level in the gas-liquid separation cavity can be less disturbed by the gas flow, thereby providing the liquid refrigerants to the second-stage throttling device more stably and reliably. These structures can be used in combination with any of the embodiments in FIGS. 2A and 2B and FIGS. 3 to 5 to achieve better results.

Figure 8A:
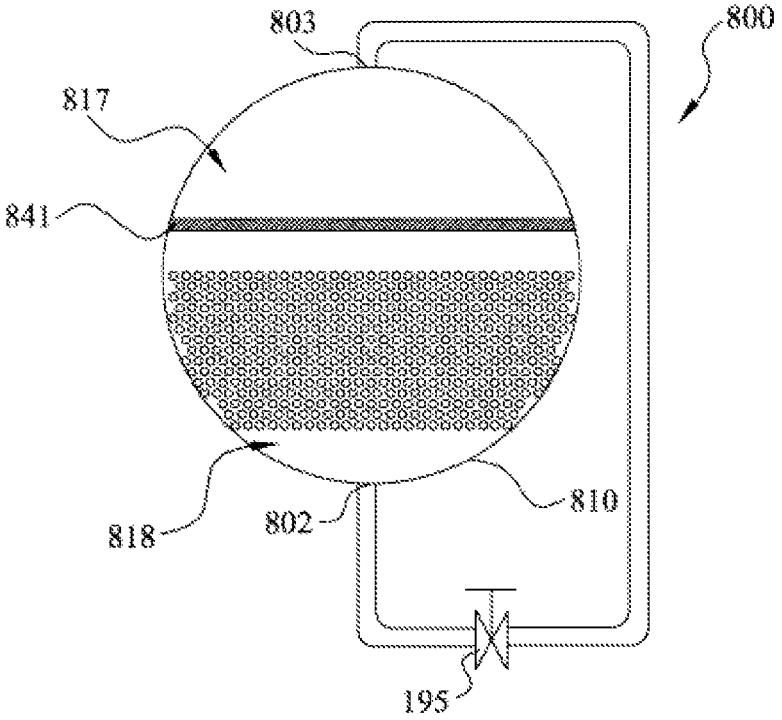
FIG. 8A is a schematic radial cross-sectional view of a seventh embodiment of the economizer in FIG. 1.
Figure 8B:
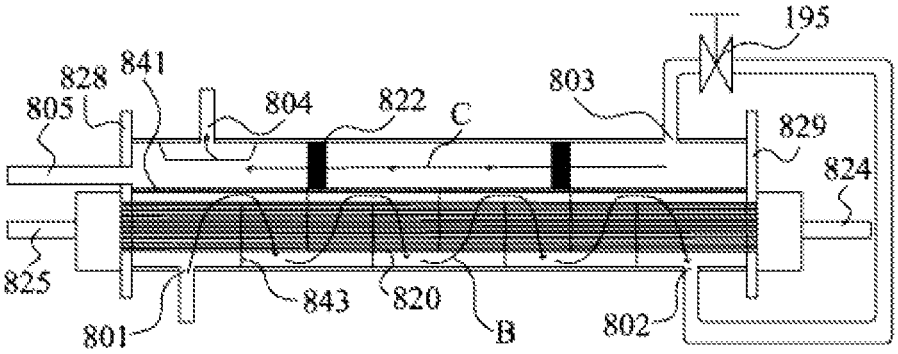
FIG. 8B is a schematic axial cross-sectional view of the economizer in FIG. 8A.

FIGS. 8A and 8B are schematic structural diagrams of a seventh embodiment of the economizer in FIG. 1, wherein FIG. 8A is a schematic radial cross-sectional view of the seventh embodiment of the economizer, and FIG. 8B is a schematic axial cross-sectional view of the seventh embodiment of the economizer. As shown in FIGS. 8A and 8B, the economizer 800 comprises an outer shell 810 and a partition plate 841. The outer shell 810 is cylindrical. The outer shell 810 also has a length direction L, a width direction W, and a height direction H. The partition plate 841 is provided laterally in the outer shell 810 along the width direction W and extends along the length direction L to divide the cylindrical space inside the outer shell 810 into a heat exchange cavity 818 and a gas-liquid separation cavity 817. As an example, the gas-liquid separation cavity 817 is located above the heat exchange cavity 818. The heat exchange cavity 818 and the gas-liquid separation cavity 817 have a common length direction L, but in this embodiment, they are separated by the partition plate 841 and therefore no longer have an axial direction. The outer shell

810 comprises a front tube plate 828 and a rear tube plate 829 for closing the heat exchange cavity 818 and the gas-liquid separation cavity 817. The heat exchange tube bundle 820 extends along the length direction L to be supported on the front tube plate 828 and the rear tube plate 829, and is in fluid communication with a cooling medium through the front tube plate 828 and the rear tube plate 829.

The economizer 800 also has an inlet 801 of the heat exchange cavity, an outlet 802 of the heat exchange cavity, an inlet 803 of the gas-liquid separation cavity, a gas outlet 804 of the gas-liquid separation cavity, and a liquid outlet 805 of the gas-liquid separation cavity. The inlet 801 of the heat exchange cavity and the outlet 802 of the heat exchange cavity are provided at the bottom of the outer shell 810, and are provided close to two ends in the length direction L. For example, the inlet 801 of the heat exchange cavity is provided at the bottom of the outer shell 810 close to the front tube plate 828, and the outlet 802 of the heat exchange cavity is provided at the bottom of the outer shell 810 close to the rear tube plate 829. In the present embodiment, in order to improve the heat exchange effect, a flow direction of the cooling medium can be set to be opposite to a flow direction of the refrigerant. For example, a water inlet 824 is provided on the outer side of the rear tube plate 829, and a water outlet 825 is provided on the outer side of the front tube plate 828. In addition, in order to further improve the heat exchange effect, the heat exchange cavity 818 is also internally provided with a plurality of baffle plates 843, and the plurality of baffle plates 843 are provided along the length direction L on a flow path of the liquid refrigerants in the heat exchange cavity 818. The baffle plates 843 are used to change the flow direction of the liquid refrigerants, so that the liquid refrigerants discharged from the condenser 191 can flow along the direction shown by arrow B, thereby extending a flow distance of the liquid refrigerants, so that the liquid refrigerants can be subjected to heat exchange fully with the cooling medium through the heat exchange tube bundle 820. As a specific example, these baffle plates 843 are connected to the outer shell 810 and the partition plate 841 in sequence, and are correspondingly spaced by a certain distance from the partition plate 841 and the outer shell 810 for the liquid refrigerants to flow through.

The first-stage throttling device 195 is also provided between the outlet 802 of the heat exchange cavity and the inlet 803 of the gas-liquid separation cavity for throttling the subcooled liquid refrigerants into two-phase refrigerants, that is, a gas-liquid mixture.

The inlet 803 of the gas-liquid separation cavity and the gas outlet 804 of the gas-liquid separation cavity are provided at the top of the outer shell 810, and are provided close to two ends in the length direction L. For example, the inlet 803 of the gas-liquid separation cavity is provided at the top of the outer shell 810 close to the rear tube plate 829, and the gas outlet 804 of the gas-liquid separation cavity is provided at the top of the outer shell 810 closet to the front tube plate 828, such that the gas-liquid mixture entering the gas-liquid separation cavity 817 from the inlet 803 of the gas-liquid separation cavity can generally form a gas flow flowing along the direction shown by arrow C. Since the density of the liquid refrigerants is greater than the density of the gas refrigerants, the gas-liquid mixture can complete gas-liquid separation under the action of gravity, wherein the gas refrigerants flow along the direction shown by arrow C and are then discharged from the gas outlet 804 of the gas-liquid separation cavity, and the liquid refrigerants are collected above the partition plate 841 at the bottom of the gas-liquid separation cavity 817 to form a liquid level of a certain height. In the present embodiment, the gas-liquid separation cavity 817 is also provided with a plurality of filter screens 822 therein. These filter screens 822 are provided along the length direction L on a flow path of the gas flow in the gas-liquid separation cavity 817 to further improve the effect of gas-liquid separation, so that the liquid refrigerants can be more fully separated from the gas flow.

The liquid outlet 805 of the gas-liquid separation cavity is provided on the outer shell 810 on one side close to the gas outlet 804 of the gas-liquid separation cavity. In the present embodiment, the liquid outlet 805 of the gas-liquid separation cavity is provided at a position, close to the partition plate 841, of the front tube plate 828, so as to discharge the liquid refrigerants collected on the partition plate 841 in a timely manner.

Therefore, the economizer of the present embodiment only needs an outer shell and a partition plate, and does not need an inner shell, to form a heat exchange cavity and a gas-liquid separation cavity. The structure is simpler, further saving manufacturing costs.

According to the economizer of the present application, the heat exchange cavity and the gas-liquid separation cavity are provided in the shell, the gas-liquid separation function of the economizer can be achieved, the heat exchange function of a subcooler can also be achieved, such that the structure of the two-stage compression refrigeration system with the function requirements of the subcooler can be more compact. Moreover, since the heat exchange tube bundle used to achieve the subcooling effect in the present application is provided outside the condenser, the refrigerant charge quantity in the refrigeration system can also be reduced, and the size requirements of the condenser can be reduced. In addition, in some embodiments of the present application, an annular columnar gas-liquid separation cavity can be formed by providing an outer shell and an inner shell with appropriate shapes, so that the centrifugal force of the gas flow when rotating in the gas-liquid separation cavity can be used to achieve the gas-liquid separation function, and thus the gas-liquid separation effect achieved by the economizer can also be improved.

Although the present application will be described with reference to specific embodiments shown in the drawings, it should be understood that the economizer and the refrigeration system of the present application may have many variations without departing from the spirit, scope, and context of the teachings of the present application. One of ordinary skill in the art will also appreciate that there are various ways to modify the structural details of the embodiments disclosed in the present application, all of which fall within the spirit and scope of the present application and claims.

The invention claimed is:

1. An economizer, comprising:

an outer shell that internally comprises a heat exchange cavity and a gas-liquid separation cavity and has a length direction;

an inner shell disposed within the outer shell, wherein the inner shell internally comprises the heat exchange cavity, the gas-liquid separation cavity encircles the inner shell, and the gas-liquid separation cavity is formed between the inner shell and the outer shell;

a heat exchange tube bundle provided in the heat exchange cavity and extending along the length direction, wherein the heat exchange tube bundle is configured to circulate a cooling medium;

an inlet of the heat exchange cavity and an outlet of the heat exchange cavity, which are in fluid communication with the heat exchange cavity; and an inlet of the gas-liquid separation cavity, a gas outlet of the gas-liquid separation cavity, and a liquid outlet of the gas-liquid separation cavity, which are provided on the outer shell and are in fluid communication with the gas-liquid separation cavity, wherein the inlet of the gas-liquid separation cavity is in fluid communication with the outlet of the heat exchange cavity through a first-stage throttling device, and the inlet of the gas-liquid separation cavity and the gas outlet of the gas-liquid separation cavity are provided to be spaced by a certain distance in the length direction, wherein the economizer is configured to enable refrigerant from a condenser to be subjected to heat exchange in the heat exchange cavity first, and then to be subjected to gas-liquid separation in the gas-liquid separation cavity after passing through the first-stage throttling device, such that gas refrigerant flows out of the gas outlet of the gas-liquid separation cavity, and liquid refrigerant flows out of the liquid outlet of the gas-liquid separation cavity, wherein the refrigerant is different from the cooling medium.

2. The economizer of claim 1, wherein:

the inner shell and the outer shell are cylindrical, an axial direction of the inner shell and the outer shell is the length direction, and the inlet of the heat exchange cavity and the outlet of the heat exchange cavity are provided on the inner shell.

3. The economizer of claim 2, wherein:

the economizer further comprises a gas-liquid separation cavity inlet tube, wherein the gas-liquid separation cavity inlet tube is connected to the inlet of the gas-liquid separation cavity, and the gas-liquid separation cavity inlet tube extends along a tangential direction of the outer shell, such that the refrigerant flows spirally along the length direction around the inner shell in the gas-liquid separation cavity to achieve gas-liquid separation via centrifugal force.

4. The economizer of claim 3, wherein:

the inner shell and the outer shell are coaxial with one another.

5. The economizer of claim 4, wherein:

the inlet of the gas-liquid separation cavity is provided on one side of the outer shell close to a bottom, and in a width direction and/or a height direction of the inner shell and the outer shell, an axis of the inner shell is arranged offset from an axis of the outer shell.

6. The economizer of claim 1, wherein:

the economizer comprises a partition plate, wherein the partition plate divides an inside of the outer shell into the heat exchange cavity and the gas-liquid separation cavity, and the inlet of the heat exchange cavity and the outlet of the heat exchange cavity are provided on the outer shell, and the inlet of the gas-liquid separation cavity is configured to guide the refrigerant into the gas-liquid separation cavity along one end of the gas-liquid separation cavity in a length direction, such that the refrigerant flows along the length direction in the gas-liquid separation cavity, thereby achieving gas-liquid separation under the action of gravity.

7. The economizer of claim 1, wherein:

the economizer further comprises at least one filter screen, and the at least one filter screen is provided on a flow path of the refrigerant in the gas-liquid separation cavity.

8. The economizer of claim 1, wherein:

the liquid outlet of the gas-liquid separation cavity is connected to a liquid collection tube and a plurality of outlet branch tubes, and each outlet branch tube of the plurality of outlet branch tubes is in fluid communication with the liquid collection tube along a length direction of the liquid collection tube.

9. The economizer of claim 1, wherein:

the refrigerant from the condenser is subjected to heat exchange in the heat exchange cavity through outer walls of heat exchange tubes in the heat exchange tube bundle.

10. The economizer of claim 1, wherein:

the gas refrigerant flows out of the gas outlet of the gas-liquid separation cavity and is provided to an air supplementing port of a compressor, and the liquid refrigerant flows out of the liquid outlet of the gas-liquid separation cavity and is provided to a second-stage throttling device.

11. The economizer of claim 1, wherein:

the economizer further comprises a liquid storage tank and a liquid level sensor, wherein the liquid storage tank is in fluid communication with the liquid outlet of the gas-liquid separation cavity to receive the liquid refrigerant, and the liquid level sensor is in communication connection with a second-stage throttling device, and wherein the liquid level sensor is configured to detect a liquid level height in the liquid storage tank, and wherein an opening degree of the second-stage throttling device is based on a detection result of the liquid level height in the liquid storage tank.

12. The economizer of claim 1, wherein:

the inlet of the gas-liquid separation cavity is provided near a bottom of the outer shell and the gas outlet of the gas-liquid separation cavity is provided near a top of the outer shell.

13. A refrigeration system, comprising:

a compressor, a condenser, an economizer, a second-stage throttling device, and an evaporator, which are provided in a refrigerant circuit, wherein the economizer comprises:

an outer shell that internally comprises a heat exchange cavity and a gas-liquid separation cavity and has a length direction;

an inner shell disposed within the outer shell, wherein the inner shell internally comprises the heat exchange cavity, the gas-liquid separation cavity encircles the inner shell, and the gas-liquid separation cavity is formed between the inner shell and the outer shell;

a heat exchange tube bundle provided in the heat exchange cavity and extending along the length direction, wherein the heat exchange tube bundle is configured to circulate a cooling medium;

an inlet of the heat exchange cavity and an outlet of the heat exchange cavity, which are in fluid communication with the heat exchange cavity, wherein the inlet of the heat exchange cavity is in fluid communication with an outlet of the condenser; and an inlet of the gas-liquid separation cavity, a gas outlet of the gas-liquid separation cavity, and a liquid outlet of the gas-liquid separation cavity, which are provided on the outer shell and are in fluid communication with the gas-liquid separation cavity, wherein the inlet of the gas-liquid separation cavity is in fluid communication with the outlet of the heat exchange cavity through a first-stage throttling device, the gas outlet of the gas-liquid separation cavity is in fluid communication with an air supplementing port of the compressor, the liquid outlet of the gas-liquid separation cavity is in fluid communication with an inlet of the second-stage throttling device, and the inlet of the gas-liquid separation cavity and the gas outlet of the gas-liquid separation cavity are provided to be spaced by a certain distance in the length direction, wherein the economizer is configured to enable refrigerant from the condenser to be subjected to heat exchange in the heat exchange cavity first, and then to be subjected to gas-liquid separation in the gas-liquid separation cavity after passing through the first-stage throttling device, such that gas refrigerant flows out of the gas outlet of the gas-liquid separation cavity and is provided to the air supplementing port of the compressor, and liquid refrigerant flows out of the liquid outlet of the gas-liquid separation cavity and is provided to the second-stage throttling device, wherein the refrigerant is different from the cooling medium.

14. The economizer of claim 5, wherein the inner shell is spaced away from the inlet of the gas-liquid separation cavity relative to a circumference of the outer shell.

* * * * *